United States Patent [19]

Schaffer

[11] 4,109,502

[45] Aug. 29, 1978

[54] CAN MAKING

[75] Inventor: Dennis A. Schaffer, Hendersonville, Tenn.

[73] Assignee: Carmet Company, Pittsburgh, Pa.

[21] Appl. No.: 827,908

[22] Filed: Aug. 26, 1977

[51] Int. Cl.[2] ..... B21D 22/28

[52] U.S. Cl. ..... 72/349; 72/468

[58] Field of Search ..... 72/347, 348, 349, 467, 72/344, 468

[56] References Cited

U.S. PATENT DOCUMENTS

| | | | |
|---|---|---|---|
| 166,568 | 8/1875 | Thomas | 72/468 X |
| 1,742,795 | 1/1930 | Tanner | 72/349 X |
| 3,359,775 | 12/1967 | Langewis | 72/344 |
| 3,399,558 | 9/1968 | Smith et al. | 72/468 |
| 3,735,628 | 5/1973 | Hutchison | 72/344 |
| 3,735,629 | 5/1973 | Paramonoff | 72/349 |
| 3,943,740 | 3/1976 | Bartenstein | 72/349 |

*Primary Examiner*—Leon Gilden

*Attorney, Agent, or Firm*—Vincent G. Gioia; Robert F. Dropkin

[57] ABSTRACT

A container for drawing or ironing dies is particularly useful but is not limited to can making. It includes an outer ring having an inwardly extending flange at one end and a disc secured to its other end so as to provide a peripheral space for receiving at least three segments which are resiliently urged against a die ring. The radial length of the slot is greater than the radial length of the segments so that the die ring can be displaced from the normal axis of the die pack. Means co-axial with the normal axis of the die limit inward movement of the segments.

12 Claims, 5 Drawing Figures

CAN MAKING

This invention relates to can making and more particularly to a die container for supporting a floating die or dies. From approximately 140 to 270 cans per minute may be made in apparatus similar to that shown in Paramonoff U.S. Pat. No. 3,735,629 dated May 19, 1973. The average can wall thickness may vary and the eccentricity or thickness at different peripheral positions may also vary, both of which require more material to be used than would otherwise be necessary. By using floating dies with positive centering these disadvantages are overcome to a great extent. While floating dies have been in successful use for more than 10 years, those of which I have knowledge have various disadvantages. The reason for using floating dies is to permit the die to move transversely when its axis does not coincide with the axis of the workpiece, but it is important that the die return accurately to its original position after it has been moved transversely by a workpiece to solve the problems set forth above. Floating dies most generally used as shown in the above mentioned Paramonoff patent does not provide for such return.

It is therefore an object of my invention to provide a tool container for floating dies which is relatively inexpensive and simple in operation and which returns the floating dies quickly to a precision center position.

Another object is to provide a method of making metal cans which results in a substantial savings in metal used.

Still another object is to provide can making machines which operate more efficiently than previous machines.

These and other objects will be more apparent after referring to the following specification and attached drawings: in which FIG. 1 is a sectional view of the apparatus of my invention;

Figure 1:
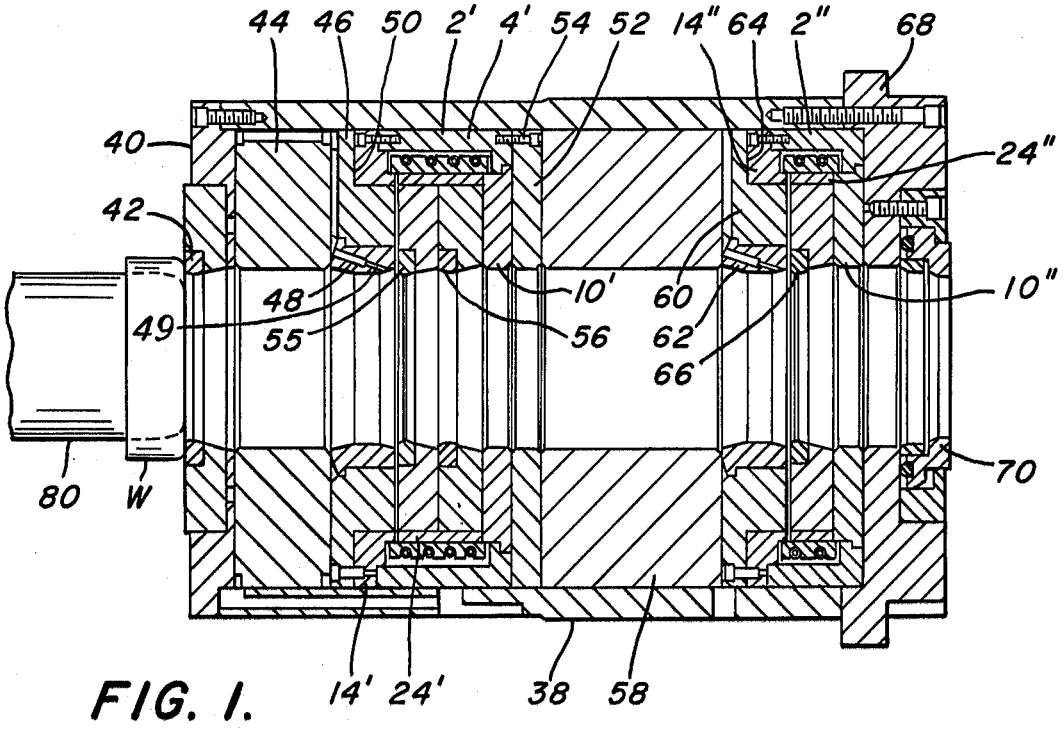
Figure 2:
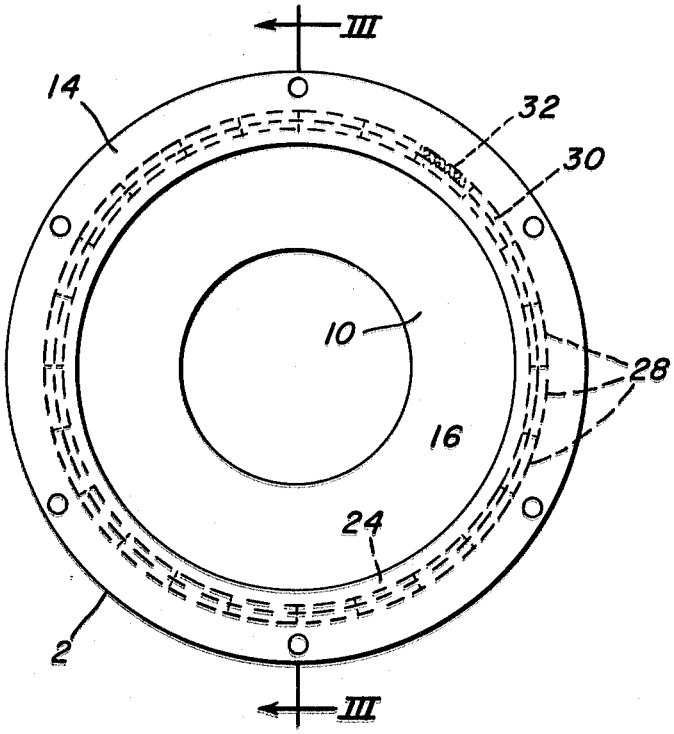
FIG. 2 is an elevation of a die container of my invention.
Figure 3:
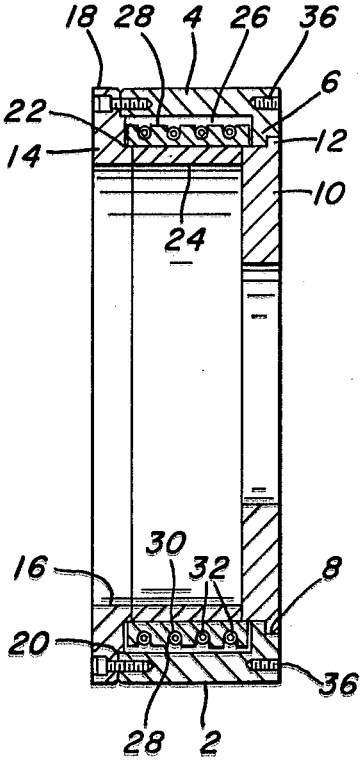
FIG. 3 is a view taken on the line III—III of FIG. 2.
Figure 4:
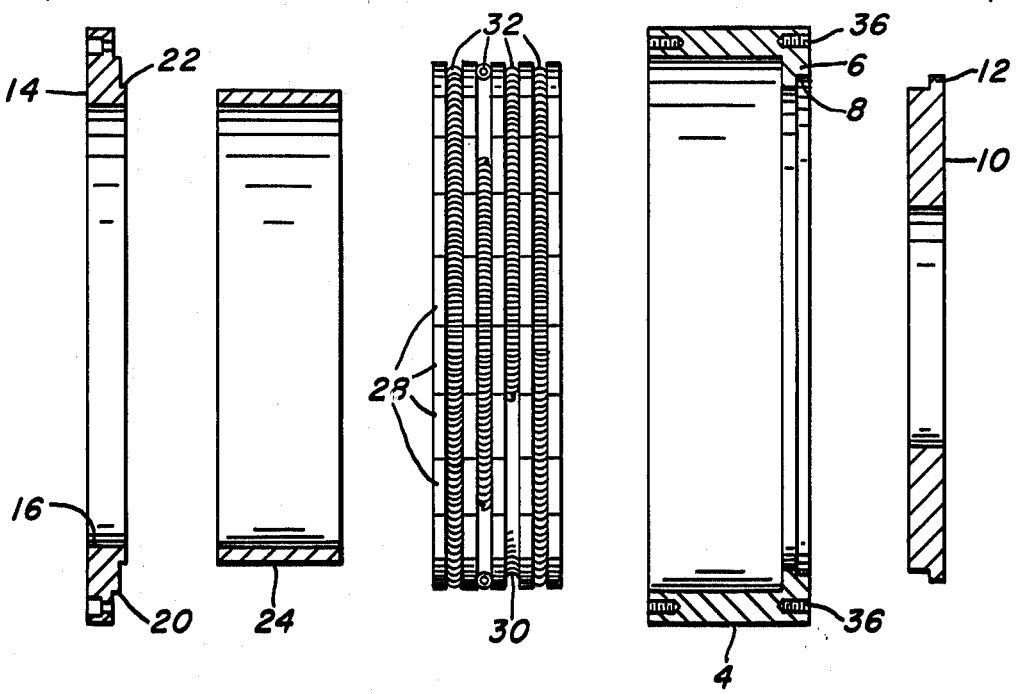
FIG. 4 is an exploded view of the container of FIG. 3.
Figure 5:
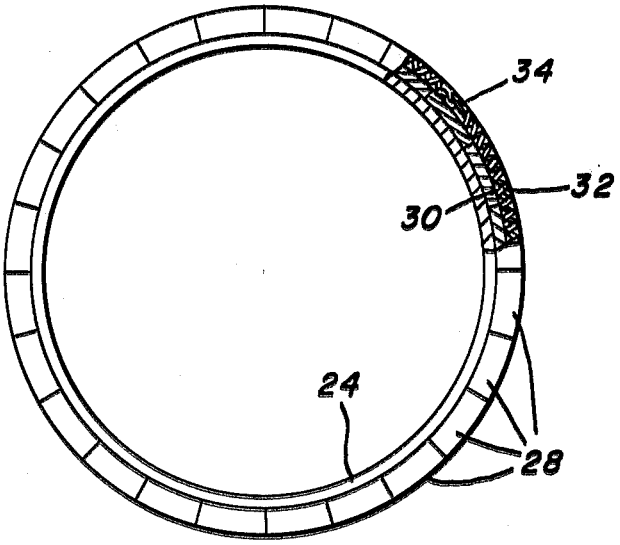
FIG. 5 is an end view, partly in section, of the die ring and segmental support of FIG. 3.

Referring more particularly to the drawings, reference numeral 2 indicates the die container of my invention. The die container 2 includes an outer steel ring 4 having an inwardly extending radial flange 6 with a peripheral groove 8 therein. A tungsten carbide wear plate or disc 10 having an outwardly extending radial flange 12 is received in one end of the ring 4 with its flange 12 in groove 8. A steel disc or cap 14 is secured to the other end of ring 4 by means of cap screws. The disc 14 has an axial hole 16 therein, an outer peripheral surface 18, an intermediate peripheral surface or shoulder 20 and an inner peripheral surface or shoulder 22 so that the disc has a minimum thickness outer portion, an intermediate thickness intermediate portion, and a maximum thickness inner portion. A floating die retaining ring 24 is received between the discs 10 and 14 and has an inner diameter smaller than the diameter of hole 16. Thus there is a space 26 between the outer ring 4 and inner ring 24 extending from the inner side of flange 6 to the intermediate portion of disc 14. The die ring may be integral with the die, but it is preferred to have it separate. At least three segments 28 are received in the opening 26 with their inner diameter being approximately the same as the outer diameter of ring 24. The segments 28 may vary in number depending upon size and other conditions, but it is preferred that their total inner surfaces be approximately equal to the outer circumference of the ring 24. The greater the number of segments, up to a reasonable number, the more precise will be the operation. The radial thickness of the segments 28 must be less than the radial width of opening 26. The segments 28 have a plurality of spaced apart outer peripheral grooves 30 therein with the grooves in each segment being aligned with corresponding grooves in the other segments. A garter spring 32 is received in each set of aligned grooves. The tension of each spring may be adjusted by a connection 34. A plurality of tapped holes 36 may be provided in outer ring 4 at the end having flange 6 for a purpose which will appear later.

My die container may be used with various types of dies such as those shown in the above identified Paramonoff patent. However, it has been successfully used in the assembly shown in FIG. 1. As there shown reference numeral 38 indicates a tubular housing having a retainer 40 at its entry end which supports a redraw die 42. A spacer 44 abuts the retainer 40. A lube distributor body 46 carrying a lube insert 48, preferably made of brass abuts the spacer 46. Lubrication is provided through conduit 49. The body 46 has a cut-out portion 50 for receiving cap 14' of double die pack 2'. A plate 52 abuts wear plate 10' and is secured to outer ring 4' by means of cap screws 54 threaded into holes 36. Front ironing die 54 and edge control die 56 are supported within die ring 24'. A spacer 58 extends between plate 52 and lube distributor body 60 having a lube insert 62 and a cut-out portion 64 for receiving cap 14'' of container 2''. An end ironing die 66 is received in die ring 24''. An end plate 68 attached to housing 38 bearing against wear plate 10 and supports stripper 70 similar to that shown in the Paramonoff patent or Huchison U.S. Pat. No. 3,735,628, dated May 29, 1973. However, because of the positive centering action of the dies the stripper need not be adjustable, thus reducing its cost.

In operation, the workpiece W in the form of a metal cup is drawn into the left end of the assembly of FIG. 1 by means of punch 80, preferably made of tungsten carbide, and the drawing takes place in a manner similar to that of the Paramonoff patent with the can being moved completely through the assembly and being stripped from the punch 80 as it is retracted. As the workpiece passes through dies 55, 56 and 66 they are free to move laterally from their normal axes. This lateral movement causes part of the segments 28 to move outwardly so as to stretch the springs 32. When the workpiece is removed the springs 32 cause the segments 28 to move rapidly back to their original position. I have found that friction is reduced by making the wear plates 10 of carbide, particularly tungsten carbide, thus improving ease of movement of the dies. Because of the precise centering of the dies and, particularly when using a tungsten carbide punch, uniform and consistent wall thicknesses are obtained, thus permitting closer wall thickness tolerances with a reduction in the amount of metal used in the finished can. Thus, the size of the workpiece may be decreased or more scrap will be recovered if the same size workpiece is used. This is particularly important when using relatively expensive metal, such as aluminum. Because of the great number of cans formed, even a small reduction in metal per can results in substantial savings.

While one embodiment has been shown and described in detail, it will be readily apparent to those skilled in the art that various adaptations and modifications may be made within the scope of the invention.

I claim:

1. A die container comprising an outer ring, two inwardly extending radial members secured to said outer ring in axially spaced relationship so as to provide a peripheral space, a floating ring having a length less than the axial length of said space positioned at the inner end of said space, said floating ring having an outer diameter substantially less than the inner diameter of said outer ring, at least three segments in said space surrounding said floating ring, the thickness of each segment being less than the average distance between said die ring and the outer wall of said peripheral space, resilient means urging said segments inwardly, and means concentric with the normal axis of the die for limiting inward movement of said segments.

2. A die container according to claim 1 in which said resilient means comprises a plurality of garter springs surrounding said segments.

3. A die container according to claim 2 including spaced apart grooves in said segments for receiving said garter springs.

4. A die container according to claim 1 in which one of said inwardly extending members is a flange integral with said outer ring at its exit end, and the other of said inwardly exyending members is a disc secured to the entry end of said outer ring.

5. A die container according to claim 4 in which said means limiting inward movement of said segments comprises a peripheral shoulder on said disc, and a second disc received in said outer ring and extending beyond its radial flange toward said first disc.

6. A die container according to claim 4 in which said spring means comprises a plurality of garter springs surrounding said segments.

7. A die container according to claim 6 in which said second disc is made of carbide.

8. A die container assembly including a plurality of die containers according to claim 1, a housing surrounding said die containers, a spacer in said housing between said die containers to hold them in spaced apart axial relationship, dies received in said die rings, and a carbide disc bearing against said dies on the exit side thereof.

9. A die container comprising an outer steel ring having an inwardly extending radial flange at one end thereof with a peripheral groove in the outer surface of said flange, a steel disc having an outer diameter substantially the same as the outer diameter of said outer ring, an intermediate peripheral surface forming a shoulder having a diameter substantially the same as the inner diameter of said outer ring, an inner peripheral surface forming a shoulder having a diameter substantially the same as the inner diameter of said flange and a central axial hole therethrough, means for fastening said disc to said outer ring at the end opposite its flange so as to provide a peripheral space therebetween, a carbide disc having a radial outer flange received in said peripheral groove and a main portion received in and closely fitting the inner end of the radial flange of said outer ring and extending axially beyond the inside of said flange, a floating ring received between said discs and having an outer diameter approximately the same as the inner diameter of the outer ring flange and an inner diameter approximately the same as the axial hole in said steel disc, a plurality of segments in said space each having an inner radius substantially equal to the outer radius of said floating ring and an outer radius substantially less than the inner radius of said outer ring, the number and peripheral length of said segments being such that they are in substantial abutting relationship when in their innermost position, a plurality of peripheral grooves in the outer surface of each segment spaced apart axially and aligned with the grooves in adjacent segments, and a garter spring in each set of aligned grooves.

10. A die container assembly including a plurality of die containers according to claim 9, a housing surrounding said die containers, a spacer in said housing between said die containers to hold them in spaced apart axial relationship, dies received in said die rings, and a carbide disc bearing against said dies on the exist side thereof.

11. Apparatus for making metal cans or the like which comprises a tubular housing, a redraw die mounted in said housing at the entry end thereof, a first floating ring mounted in said housing, an ironing die mounted in the entry end of said die ring, a second die mounted in the exit end of said floating ring, a carbide wear plate bearing against the exit end of said second die, a second floating ring spaced from said first floating ring in said housing, a third die mounted in said second floating ring, a second carbide wear plate bearing against the exit end of said third die, a stripper mounted on the exit end of said tubular housing, at least three segments surrounding each of said floating rings, and outer ring in said housing surrounding each floating ring in radially spaced relationship to provide a space for receiving said segments, the thickness of each segment being less than the average distance between said floating ring and the outer wall of said peripheral space, resilient means urging said segments inwardly, means concentric with the normal axis of the dies for limiting inward movement of said segments, and a carbide punch for forcing the can through said dies.

12. Apparatus according to claim 11 including a lube insert on the entry side of said ironing die and said third die, and means for providing lubricant to said lube inserts.

* * * * *